United States Patent [19]

van Gils

[11] Patent Number: 4,481,441

[45] Date of Patent: Nov. 6, 1984

[54] METHOD OF MANUFACTURING A PICTURE DISPLAY TUBE HAVING A GAS-ABSORBING LAYER; PICTURE DISPLAY TUBE THUS MANUFACTURED, AND GETTERING DEVICE SUITABLE FOR SUCH A METHOD

[75] Inventor: Wilhelmus A. van Gils, Eindhoven, Netherlands

[73] Assignee: U.S. Philips Corporation, New York, N.Y.

[21] Appl. No.: 351,574

[22] Filed: Feb. 23, 1982

[30] Foreign Application Priority Data

Mar. 24, 1981 [NL] Netherlands ..... 8101459

[51] Int. Cl.[3] ..... H01J 9/20

[52] U.S. Cl. ..... 313/481; 417/48; 445/19; 445/55

[58] Field of Search ..... 445/9, 19, 31, 55; 417/48, 51; 313/481

[56] References Cited

U.S. PATENT DOCUMENTS 3,195,716 7/1965 Porta ..... 417/48
3,388,955 6/1968 Porta et al. ..... 445/16
3,669,567 6/1972 Porta et al. ..... 417/48
4,066,309 1/1978 Hellier ..... 445/10
4,225,805 7/1980 Smithgall et al. ..... 313/481

FOREIGN PATENT DOCUMENTS 1405045 9/1975 United Kingdom ..... 445/55

*Primary Examiner*—Kenneth J. Ramsey
*Attorney, Agent, or Firm*—Robert J. Kraus

[57] ABSTRACT

A gettering device installed in a picture display tube includes an annular, channel-shaped metal holder containing an evaporable gettering metal and a heat-activated gas releasing material. The gas releasing material is disposed in the holder against a surface which rapidly increases in temperature in response to inductive heating of the holder. This material is covered by the gettering metal to protect it against deterioration by exposure to moist, high temperature air during tube manufacturing processes occurring after installation of the device. During inductive heating, the temperature of the gas releasing material increases faster than that of the gettering metal and begins releasing gas before the gettering metal begins to evaporate.

21 Claims, 3 Drawing Figures

METHOD OF MANUFACTURING A PICTURE DISPLAY TUBE HAVING A GAS-ABSORBING LAYER; PICTURE DISPLAY TUBE THUS MANUFACTURED, AND GETTERING DEVICE SUITABLE FOR SUCH A METHOD

BACKGROUND OF THE INVENTION

The invention relates to a method of manufacturing a picture display tube in which a gettering device is mounted in the tube. The gettering device comprises a metal holder in which are accommodated a source of evaporable gettering metal and a gas source of a material which releases gas upon heating. After evacuating the tube, the gettering device is heated inductively to release the gas from the gas source and to evaporate the gettering metal from the source of gettering metal.

The invention further relates to a picutre display tube thus manufactured, as well as to a gettering device suitable for use in the above-mentioned method.

Such a method is disclosed in U.S. Pat. No. 3,388,955. In this method the metal holder of the gettering device comprises a gettering metal to be evaporated which is mixed with a gas source of gasreleasing material. During the inductive heating of the gettering device, first the gas is released from the gas source and the gettering metal is then evaporated. The gettering metal is evaporated in a gas atmosphere to obtain a uniform distribution of gettering metal on an inner surface of the display tube.

The known gettering device comprises a gas source consisting of iron nitride powder ($Fe_4N$) which is mixed with the source of gettering metal in powder form. In such a gettering device the iron nitride is attacked by moist air of approximately 450° C., which condition is met, for example, in the manufacture of a colour television display tube when the display window and the cone of the display tube are sealed together by means of a sealing glass. The known gettering device may not be installed in the tube before the display window and the cone are secured together. This is a serious restriction inter alia in the manufacture of a colour display tube having a resistive layer provided internally on a part of the tube wall, as described in British patent specification No. 1,226,728. The resistive layer is provided near the neck-cone transition of the tube, which makes it necessary for the gettering device to be disposed in the tube in a place remote from the neck-cone transition, to avoid forming an electric shortcircuit on the resistive layer by means of gettering metal evaporated from the gettering device. Because of its inaccessibility after the window is secured, it is desirable to install the gettering device in a place remote from the cone-neck transition before the cone is secured to the window of the tube. Such installation is an improvement over the typical insertion of the gettering device by means of a resilient metal strip attached to the gun system disposed in the neck of the tube thereby avoiding the resilient force exerted on the gun system by the metal strip.

A gas source which can be exposed to moist air of at least 450° C. without any adverse effects is described in British patent specification No. 1,405,045. In this Specification the gas source comprises a germanium nitride, in particular $Ge_3N_4$, as a gas-releasing material. Germanium nitride is a stable compound having a decomposition temperature which is comparatively high with respect to iron nitride. This has for its result that upon heating the gettering device, the gas source accommodated therein gives off its nitrogen only during the evaporation of the gettering metal. In order to obtain a layer of gettering metal which is porous through-out its thickness and hence is readily absorbing on an internal surface of the tube, it is necessary that during the heating of the gettering device the gas released from the gas source has already built up a sufficient pressure of approximately $133\times10^{-3}$ to $666\times10^{-2}$ Pa in the tube before the gettering metal begins to evaporate.

SUMMARY OF THE INVENTION

It is an object of the invention to provide a method of manufacturing a picture display tube in which a gettering device is used which can be exposed to moist air of 450° C. without any adverse effects and which has a gas source of which the giving-off of gas in the tube has been completed for the greater part before the gettering metal begins to evaporate.

According to the invention, a method of manufacturing a picture display tube in which a gettering device is mounted in the tube, which gettering device comprises a metal holder in which are accommodated a source of evaporable gettering metal and a gas source of a material releasing gas upon heating, which gettering device, after evacuating the tube, is heated inductively to release the gas from the gas source and to evaporate the gettering metal from the source of gettering metal, is characterized in that a gettering device is used in which the gasreleasing material is concentrated in a layer which internally adjoins a wall portion of the metal holder.

During inductive heating, the gettering device first will become warm at the area where the induction currents generated by the induction field in the gettering device are maximum. With a high frequency induction field, the gettering device will become warm first at the bottom and on the outside, that is to say that the metal holder of the gettering device leads in temperature relative to the filling of the holder. By concentrating the gas-relasing material in a layer which internally adjoins a wall portion of the metal holder of the gettering device it is achieved that during the inductive heating of the gettering device the temperature of the gas-releasing material leads with respect to the other contents of the metal holder, that is to say, the source of evaporable gettering metal. This has for its result that the gasreleasing material, even when it has a comparatively high decomposition temperature, gives off its gas before the gettering metal begins to evaporate from the metal holder.

As compared with a gettering device in which the gas source in powder form is mixed with the source of gettering metal in powder form, the invention has the further advantage that the material of the gas source is better sealed from the surrounding atmosphere. The invention therefore permits the use of chemically less resistant gas sources in an atmosphere of warm moist air, for example, iron nitride.

The invention also permits the use of gas sources which, if mixed with the source of gettering metal, during the gettering would have a negative influence on the yield of gettering metal. Due to the separated positions of the gas source and the source of gettering metal, this latter problem does not present itself in a gettering device according to the invention.

The metal holder of the gettering device has a shape which is suitable for inductive heating and it usually consists of an annular channel or a circular tray. Both the source of gettering metal and the gas source consists of material in powder form which is pressed in the metal holder. However, the quantity by weight of gasreleasing material is small with respect to the quantity by weight of the material of which the source of gettering metal consists. The source of gettering metal usually is a mixture of nickel powder and a powdered alloy of aluminum and the gettering metal, in which mixture the content of nickel powder is approximately 40–60% by weight. This source of gettering metal determines substantially the total filling weight of the metal holder of the gettering device. The quantity by weight of gas-releasing material usually is one to a few per cent, of the total filling weight of the metal holder. In order to obtain a laminated structure with respect to the gas-releasing material and the material of the source of gettering metal, it is possible when filling the metal holder to dose the gasreleasing material separately. As a result of the small quantity of gas-releasing material required per gettering device, high requirements are imposed in this method on the dosing accuracy of the filling apparatus used for filling the metal holder. The filling apparatus often operates reliably only when a given minimum quantity of powder is dosed. If this minimum quantity is larger than the quantity of gas-releasing material required per gettering device, this problem can be solved by dosing the gasreleasing material while mixed with another powdered material. This means that the quantity of gas-releasing material required for a gettering device is supplemented with the other powdered material up to at least the quantity of powder required minimally for an accurate dosing. The layer which internally adjoins a wall portion of the metal holder of the gettering device according to the invention consists of a mixture of gas-releasing material in powder form and another material in powder form. This other material in powder form may be any suitable material, but preferably it is a material of which the source of gettering metal is also composed or of at least one of the components thereof.

According to an embodiment of the invention, the layer in which the gas-releasing material is concentrated adjoins the bottom wall of the metal holder. The filling of the metal holder then comprises a first phase in which the metal holder is partly filled with the gas-releasing material, mixed or not mixed with another material in powder form. In a second phase the metal holder is then supplied with the desired quantity of material which forms the source of the gettering metal, and the powdered filling is then compressed in the holder. It is also possible to use pre-compressed filling bodies and post-compress these filling bodies in the metal holder. This method is particularly suitable and may be used either for the material of the source of the gettering metal or for the gas-releasing material mixed with another material in powder form, or for both sources.

According to an embodiment of the invention, the gas source consists of a gas-releasing material which gives off its gas only at temperatures higher than approximately 700° C. The advantage of such a gas source is that the gettering device can be pre-degassed to approximately 650° C., so that it is thoroughly liberated from gases which are not absorbed as such by the layer of gettering metal provided in the tube, for example, argon. This is of importance because such gases can shorten the life of the tube in which the gettering device is used.

A very suitable gas-releasing material is germanium nitride, in particular $Ge_3N_4$. Germanium nitride is chemically a particularly resistent compound which in a vacuum begins to decompose at approximately 825° C. and decomposes very rapidly at approximately 900° C. When such a gas source is used in combination with a chemically resistent source of gettering metal, a gettering device is obtained which has the advantage, as compared with the known gettering devices, that it can be assembled in its place inside the tube envelope before the window and the cone of the display tube are secured together in the manufacture of a display tube. A chemically resistent material is to be understood to mean herein a material which can withstand the attack by moist air of approximately 450° C. for at least one hour. As already stated, this is of particular importance in the manufacture of display tubes having a resistive layer disposed on an internal wall portion of the tube.

Another very suitable chemically resistant gas source consists of an iron-chromium-germanium nitride, in particular $Fe_{60}Cr_7Ge_{33}$ nitride. This nitride gives off its nitrogen at approximately 650° C. and is preferably provided in the getter holder in the form of a precompressed ring.

The resistance of the gettering device against the action of the ambient atmosphere as such is a great advantage, since this enables storage of the gettering device for a long period of time without reducing the usefulness of the gettering device.

BRIEF DESCRIPTION OF THE DRAWING

Embodiments of the invention will be described in greater detail, by way of example, with reference to the drawing, in which.

DESCRIPTION OF THE PREFERRED EMBODIMENTS

Figure 1:
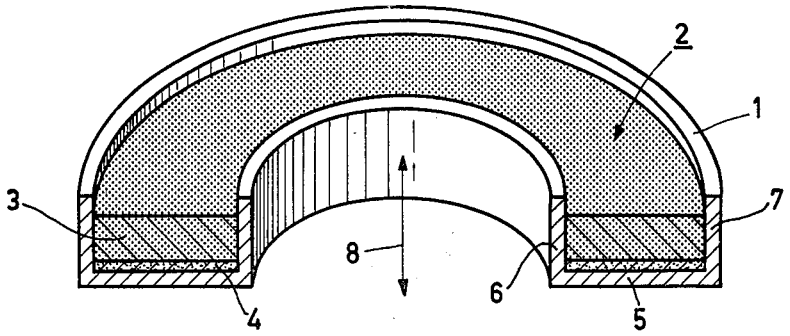
FIG. 1 is a partial sectional view of a gettering device suitable for use in a method according to the invention.

The gettering device shown in FIG. 1 comprises a chromium-nickel channel 1 having a bottom 5 and two side walls 6 and 7, in which channel a powdered filling material 2 is compressed consisting of a layer 4 adjoining the bottom 5 and a layer 3 provided on the layer 4. The layer 4 comprises approximately 8 mg of gas-releasing material in the form of germanium nitride powder ($Ge_3N_4$) which is dosed while mixed with approximately 36 mg of barium aluminum powder and 36 mg of nickel powder. The weight of the powder mixture in the layer 4 thus is approximately 80 mg, which quantity can more easily be dosed than the comparatively small quantity of 8 mg of germanium nitride. The layer 3 forms the source of gettering metal and consists of approximately 1,070 mg of a mixture of barium aluminum powder and nickel powder in the weight ratio 1:1.

The source of gettering metal, in the present case the source of barium, can withstand attack by moist air of approximately 450° C. for at least one hour due to a suitable choice of the grain sizes of the barium aluminum powder and the nickel powder. As described in U.S. patent specification No. 4,077,899, the contents of which are deemed to be incorporated in this Application by reference, the nickel powder in such a source of gettering metal has for that purpose an average grain size smaller than 80 microns and a specific area smaller than 0.15 $m^2$ per gram, while the average grain size of the barium alumiminium powder is smaller than 125 microns.

For the inductive heating, the gettering device is subjected to a high-frequency induction field, in which the field lines have the direction indicated in FIG. 1 by the double arrow 8. As a result of this induction field, induction currents are formed in the metal holder 1 and the filling material 2, as a result of which the temperature of the gettering device rises. The induction currents will be largest at the outer circumference 7 and at the bottom 5 of the gettering device, so that the gettering device will become warm there first. In the gettering device shown in FIG. 1, the germanium nitride will hence decompose and give off its nitrogen before the barium begins to evaporate from the source of gettering metal 3.

Figure 2:
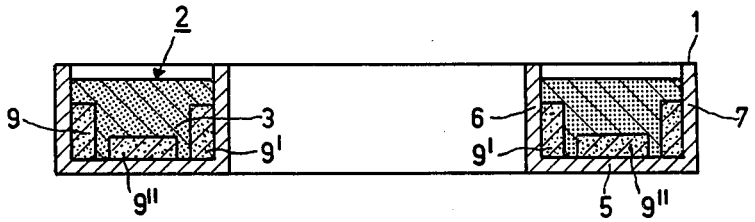
FIG. 2 is a sectional view of another embodiment of a gettering device.

The layer 4 may also be provided in the metal holder 1 as a precompressed ring. FIG. 2 shows an embodiment which is slightly varied in this respect. The ring 9 shown in this Figure consists of a precompressed body of the same composition as the layer 4 in FIG. 1. The ring 9 internally adjoins the wall 7 of the holder 1 instead of the bottom 5. In this construction also the germanium nitride incorporated in the ring 9 gives off its nitrogen before the barium begins to evaporate from the source of gettering metal denoted by 3 in this Figure also.

When gas sources having a comparatively low decomposition temperature are used, the position of the gas source in the metal holder is of minor importance. When, for example, an iron-chromium-germanium nitride, such as $Fe_{60}Cr_7Ge_{33}$ nitride, is used, the gas source may also be provided in the form of a precompressed ring 9' or 9'', as shown in FIG. 2. The same applies when a gas source is used consisting of iron nitride (decomposition temperature of approximately 500° C.)

Figure 3:
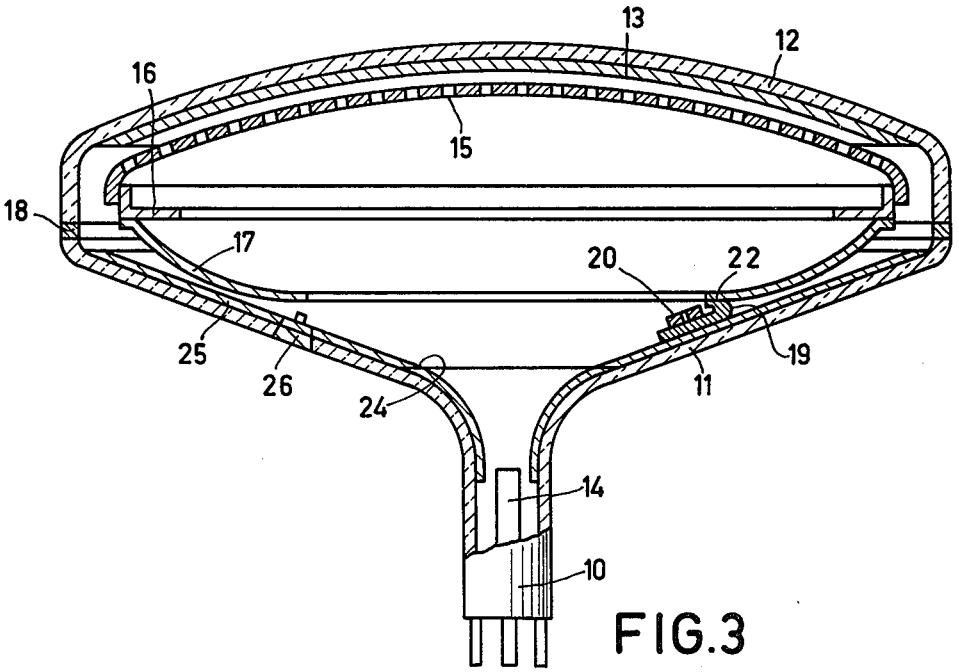
FIG. 3 is an axial sectional view of a colour television display tube manufactured while using the gettering device shown in FIG. 1.

Since a gettering device according to the invention gives a freedom of choice with respect to the moment in the manufacturing process of a display tube at which the gettering device is mounted inside the envelope of the display tube, the invention is extremely suitable for use in the manufacture of display tubes, said moment of mounting being in an early stage of the manufacturing process. This aspect of the invention will be described with reference to FIG. 3. The colour television display tube shown diagrammatically in this Figure has a neck 10, a cone 11 and a window 12 of glass. A layer 13 of areas luminescing in red, green and blue is provided on the inside of the window 12 and in known manner forms a pattern of lines or a pattern of dots. The tube further comprises a metal shadow mask 15 which, like a metal magnetic screening cap 17, is secured to a metal supporting frame 16. In an annular metal holder 20 of a gettering device characterized according to the invention are provided a source of gettering metal in the form of a mixture of barium-aluminum powder and nickel powder, as well as a source of nitrogen in the form as described with reference to FIG. 1 or 2. A metal strip 19 is welded to the holder 20 and is secured to the screening cap 17 at 22. It is also possible to secure the strip 19 to a high voltage contact 26 sealed in the tube wall. After providing this gettering device in place, the window 12 is secured to the cone 11 in a vacuum-tight manner by means of a sealing glass 18. In this process which lasts approximately one hour and takes place in a furnace at a temperature of approximately 450° C., water vapour is released from the sealing material. The gettering device characterized according to the invention can be exposed to these circumstances without any objection. After the sealing process, a system of guns 14 shown diagrammatically and with which three electron beams can be generated, is placed in the neck of the tube and the tube is evacuated.

Finally, the gettering device 20 is brought to a temperature range by inductive heating, in which first nitrogen is introduced in the tube by thermal decomposition of the germanium nitride and an exothermally occurring reaction is then brought about between the barium-aluminium and the nickel. The barium evaporates, is scattered by the nitrogen, and is deposited as a thin layer of gettering metal on surfaces inside the space defined by the mask 15 and the screening cap 17. The place and the spatial orientation of the gettering device are such that the part of a resistive layer 25 on the internal surface of the tube between the line 24 and the system of guns 14 is not covered with barium. Such a resistive layer functions to minimize the detrimental results which a possible high voltage breakdown in the tube may have for certain components in the control circuit connected thereto. In a usual connection of the gettering device to a gun system, or to an element connected to a gun system, the resistive layer is short circuited by the deposited barium, which is prevented by the above-indicated placement of the gettering device.

Although the invention has been described with reference to a gettering device which comprises as a source of gettering metal a mixture of barium-aluminum powder and nickel powder, it is not restricted thereto. The invention may also be performed while using other gettering metals, such as strontium, calcium and magnesium. In order to obtain a chemically resistant source of gettering metal, measures other than those described above may also be taken. For example, the nickel powder in this source may be replaced by a chemically resistant nickel-titanium compound or an iron-titanium compound. It is also possible to cover the surface of the source of gettering metal exposed to the atmosphere with a protective layer of, for example, aluminum or an organo-silicon compound.

What is claimed is:

1. A method of manufacturing a picture display tube comprising positioning in the tube a gettering device including a metallic holder containing gas releasing material and an evaporable gettering metal, sealing and evacuating the tube, and inductively heating the device to effect coating of an inner surface of the tube with the gettering metal, characterized in that the gas releasing material is placed against an inner wall of the metallic holder and is covered by the evaporable gettering metal, said gas releasing material being positioned in the metallic holder relative to the gettering metal to effect heating of the material to its gas-releasing temperature before the covering gettering metal is heated to its evaporation temperature.

2. A method as in claim 1 where the gas releasing material comprises a powdered layer compressed against said inner wall.

3. A method as in claim 2 where the gas releasing material comprises a mixture including a gas releasing component and a filler component, the gettering metal also including said filler component.

4. A method as in claim 1 where the gas releasing material is disposed against a bottom wall of the metallic holder.

5. A method as in claim 1 where the gas releasing material comprises a pre-compressed body.

6. A method as in claim 1 where the gas releasing material consists essentially of iron nitride.

7. A method as in claim 1 where the gas releasing material consists essentially of iron-chromium-germanium nitride.

8. A method as in claim 1 where the gas releasing temperature is higher than approximately 700° C.

9. A method as in claim 8 where the gas releasing material consists essentially of germanium nitride.

10. A method as in claim 8 where the gas releasing material consists essentially of $Ge_3N_4$.

11. A gettering device for applying a gettering metal to an inner surface of an evacuated picture display tube in response to inductive heating of the device, said device comprising a metallic holder containing a gas releasing material and the evaporable gettering metal, characterized in that the gas releasing material is disposed against an inner wall of the metallic holder and is covered by the evaporable gettering metal, said gas releasing material being positioned in the metallic holder relative to the gettering metal to effect heating of the material to its gas-releasing temperature before the covering gettering metal is heated to its evaporation temperature.

12. A gettering device as in claim 11 where the gas releasing material comprises a powdered layer compressed against said inner wall.

13. A gettering device as in claim 12 where the gas releasing material comprises a mixture including a gas releasing component and a filler component, the gettering metal also including said filler component.

14. A gettering device as in claim 11 where the gas releasing material is disposed against a bottom wall of the metallic holder.

15. A gettering device as in claim 11 where the gas releasing material comprises a pre-compressed body.

16. A gettering device as in claim 11 where the gas releasing material consists essentially of iron nitride.

17. A gettering device as in claim 11 where the gas releasing material consists essentially of iron-chromium-germanium nitride.

18. A gettering device as in claim 11 where the gas releasing temperature is higher than approximately 700° C.

19. A gettering device as in claim 18 where the gas releasing material consists essentially of germanium nitride.

20. A gettering device as in claim 19 where the gas releasing material consists essentially of $Ge_3N_4$.

21. A picture display tube including a gettering device for applying a gettering metal to an inner surface of the display tube in response to inductive heating of the device, said device comprising a metallic holder containing a gas releasing material and the evaporable gettering metal, characterized in that the gas releasing material is disposed against an inner wall of the metallic holder and is covered by the evaporable gettering metal, said gas releasing material being positioned in the metallic holder relative to the gettering metal to effect heating of the material to its gas-releasing temperature before the covering gettering metal is heated to its evaporation temperature.

* * * * *